US005890547A

United States Patent [19]

Nilsen

[11] Patent Number: 5,890,547

[45] Date of Patent: Apr. 6, 1999

[54] PRESSURE CONVERTER

[75] Inventor: Nils Inge Nilsen, Kvernaland, Norway

[73] Assignee: Den Norske Stats Oljeselskap A.S, Stavanger, Norway

[21] Appl. No.: 809,992

[22] PCT Filed: Oct. 4, 1995

[86] PCT No.: PCT/NO95/00178

§ 371 Date: Apr. 11, 1997

§ 102(e) Date: Apr. 11, 1997

[87] PCT Pub. No.: WO96/12082

PCT Pub. Date: Apr. 25, 1996

[30] Foreign Application Priority Data

Oct. 12, 1994 [NO] Norway ..... 943858

[51] Int. Cl.[6] ..... E21B 4/00

[52] U.S. Cl. ..... 173/206; 175/93; 175/107

[58] Field of Search ..... 173/15, 17, 206, 173/207; 175/93, 95, 107, 324

[56] References Cited

U.S. PATENT DOCUMENTS

| | | | |
|---|---|---|---|
| 1,142,478 | 6/1915 | Bayles | 173/206 |
| 5,246,080 | 9/1993 | Horvei et al. | 175/93 |
| 5,361,857 | 11/1994 | Horvei | 175/93 |
| 5,375,671 | 12/1994 | Horvei | 175/93 |
| 5,429,036 | 7/1995 | Latos . | |

FOREIGN PATENT DOCUMENTS

| | | |
|---|---|---|
| 0333484 | 9/1989 | European Pat. Off. . |
| 0335543 | 10/1989 | European Pat. Off. . |
| 169088 | 5/1992 | Norway . |
| 171322 | 2/1993 | Norway . |
| 171323 | 2/1993 | Norway . |
| 171325 | 2/1993 | Norway . |
| 91/07566 | 5/1991 | WIPO . |
| 92/08871 | 5/1992 | WIPO . |
| 92/08872 | 5/1992 | WIPO . |

*Primary Examiner*—Stephen F. Gerrity
*Attorney, Agent, or Firm*—Foley & Lardner

[57] ABSTRACT

Pressure amplifier for mounting above the drill bit at the lower end of a drill pipe for generating an increased fluid pressure in a drilling fluid flow, for example for obtaining an increased drilling effect. A reciprocating piston in a cylinder is designed with a large piston area at one end (low pressure side), a relatively small piston area at the opposite end (high pressure side), and an annular surface formed at the transition between the two ends. The pressure converter also includes a control valve, an actuator, and a drilling fluid valve to control drilling fluid flow to and from the cylinder.

10 Claims, 6 Drawing Sheets

PRESSURE CONVERTER

CROSS REFERENCE TO RELATED APPLICATIONS

This application is related to and claims priority from Patent No. WO 96/12082 filed Oct. 4, 1995, which is related to and claims priority from Patent No. NO 943858 filed Oct. 12, 1994.

BACKGROUND OF THE INVENTION

1. Field of the Invention

This invention relates to an improved design of a pressure amplifier or converter for mounting above the drill bit at the lower end of a drill pipe for deep drilling, in particular for oil and gas, and for generating an increased fluid pressure by utilizing energy from the flow of drilling fluid downwards through the drill string and the drill pipe. This may be, inter alia, for the purpose of obtaining an enhanced drilling effect, preferably by means of one or more high pressure jets adapted to have a cutting effect in the surrounding rock.

2. Description of the Related Art

The invention can be regarded as a further development and improvement of structures described in Norwegian Patent Specification Nos. 169.088, 171.322, 171.323 and 171.325. Norwegian Patent 171.323 is particularly directed to a valve assembly for this type of pressure converter, which advantageously can be replaced by the new and improved designs described below. The new designs involve, inter alia, less wear of vital valve parts and better reliability and safety under the extreme conditions that the structures are subjected to in use.

SUMMARY OF THE INVENTION

As in the pressure converters described in the above Norwegian Patent Specifications, the present invention includes an arrangement comprising a reciprocating piston having a pressure stroke and a return stroke between opposite end positions in a cylinder. The pressure converter includes a cylinder having a bore with a first section and a second section, the first section having a larger diameter than the second section. A reciprocating piston is located in the cylinder, with having a first end, a second end, and an annular surface, the first end having a larger diameter than the second end, the annular surface formed at the transition between the first and second ends. The first end defines a first cavity in the first section of the bore, the second end defines a second cavity in the second section of the bore, and the annular surface defines a third cavity in the first section of the bore. A first channel connects the first cavity to the annulus outside the drill pipe during a return stroke, and a drilling fluid valve for controls the drilling fluid flow to and from the first cavity. A second channel with a check valve connects the second cavity in fluid flow communication with the drill bit. A third channel connects the third cavity to the annulus outside the drill pipe at least during a pressure stroke.

The pressure converter also includes a control valve with a control valve body, a slide member moveable between opposite ends of the control valve body, and a slide rod cooperating with the piston for moving the slide member in the control valve body, and an actuator for adjusting the drilling fluid valve to control drilling fluid flow to and from the low pressure cavity. The actuator is in fluid flow communication with the control valve and the actuator is operated by drilling fluid pressure supplied from the control valve.

BRIEF DESCRIPTION OF THE DRAWINGS

In the following description, the new structural solutions according to the invention as well as additional advantages and specific features thereof will be more closely explained with reference to the drawings, wherein.

DETAILED DESCRIPTION OF THE PREFERRED EMBODIMENT

Since the present pressure converter as far as the main features thereof are concerned, except for the valve arrangement, is closely related to corresponding structures according to the above mentioned Norwegian Patent Specifications, it seems to be sufficient here just to include a short discussion of these main features and functions.

Figure 1:
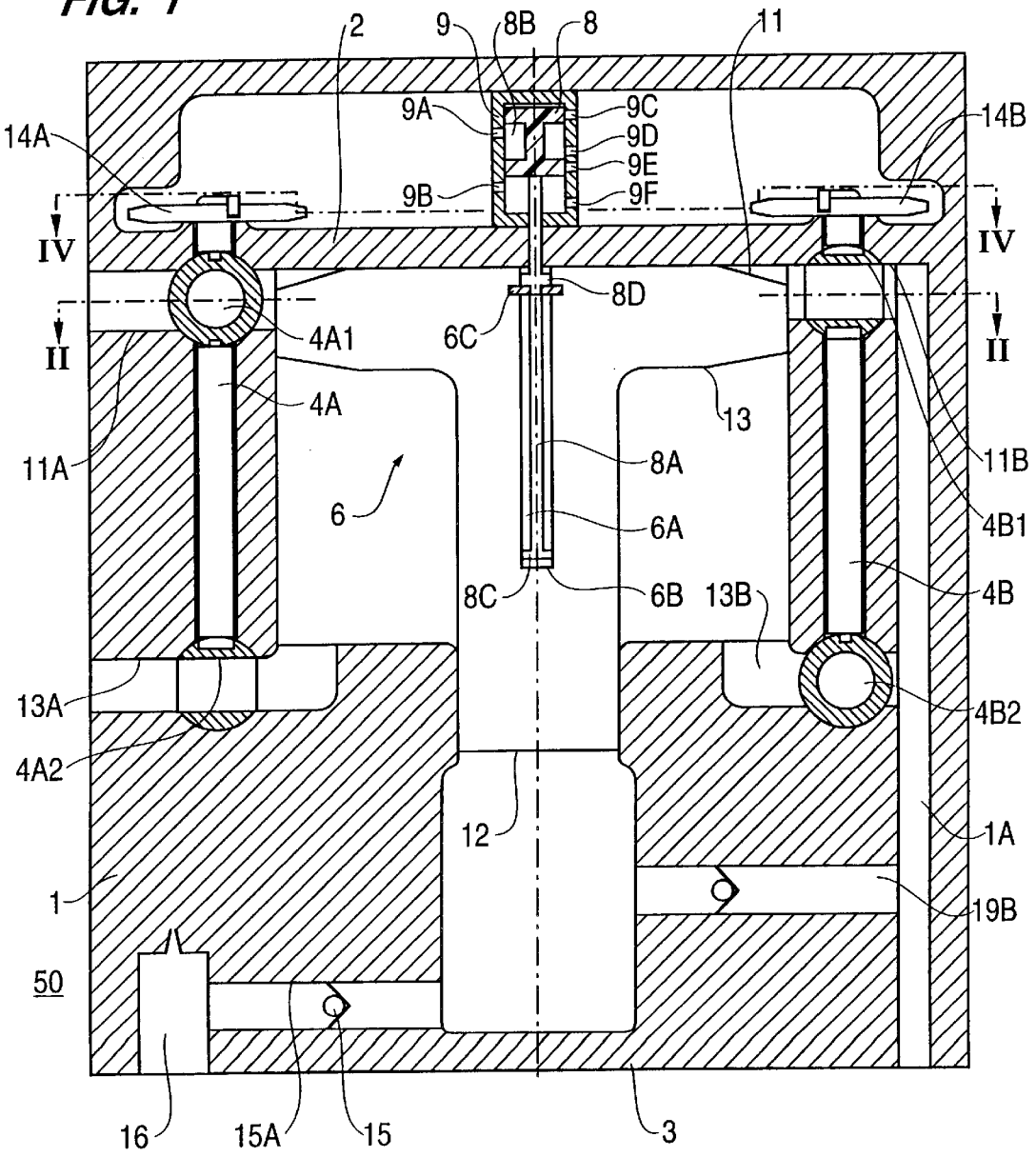
FIG. 1 in longitudinal sectional view shows a first embodiment of a pressure converter according to the invention, with the piston in an upper end position.
Figure 2:
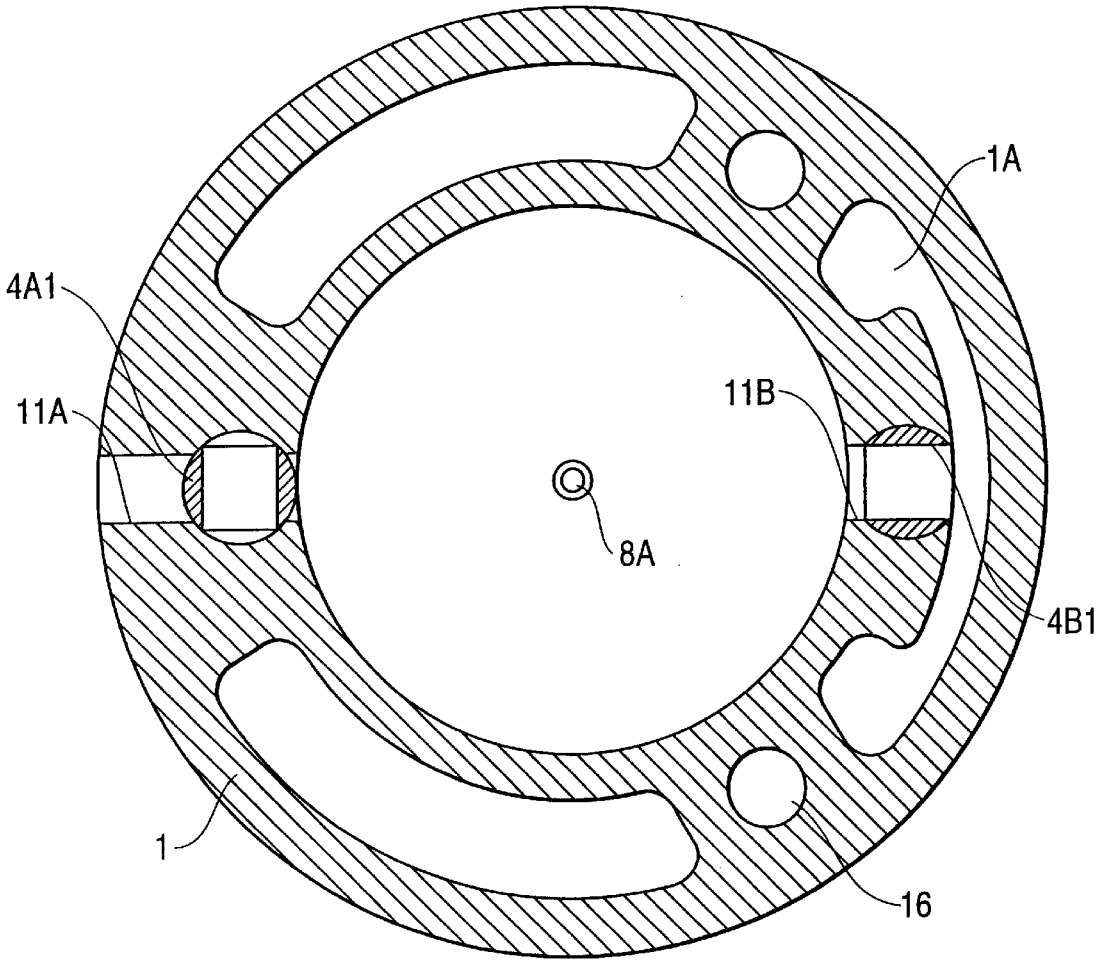
FIG. 2 shows a cross-sectional view along lines II—II in FIG. 1.

As in the previously proposed designs, the embodiment of FIG. 1 comprises a generally cylindrical housing 1, 2 and 3 adapted to accommodate the piston 6. The piston includes three active piston areas, i.e. an upper relatively large piston area 11, a first opposite piston area 13 and a second opposite and relatively small piston area 12 at the lower end of piston member 6. The piston is adapted to be freely movable axially under the influence of varying drilling fluid pressure on the respective piston areas.

The space or volume in front of piston area 11, can be designated a low pressure space, whereas the volume in front of piston area 12 correspondingly can be denoted a high pressure space. This latter space is connected through a channel 15A with a check valve 15, to a header channel 16, for transport of the drilling fluid at an increased pressure. Channel 16 runs through the whole housing in a longitudinal direction for the purpose of interconnecting several such pressure converter units into a group, as will be discussed below with reference to FIG. 6.

The valve arrangement according to the invention in the embodiment shown in FIGS. 1–4 comprises two rotatable valve bodies 4A and 4B each provided with respective through-flow openings 4A1, 4A2 and 4B1, 4B2. These valve bodies 4A and 4B are located in the cylinder wall 1 diametrically opposite to one another. Valve bodies 4A and 4B are adapted to be moved from open to closed position of the openings 4A1, 4A2, 4B1 and 4B2 respectively. In FIG. 1 (and FIG. 2) valve balls 4B1 and 4A2 are depicted in an open position for flow through the valve balls 4B1 and 4A2, whereas the other two are closed. A control and actuator device for positioning valve bodies 4A and 4B will be explained more closely below. At this point, a short discussion of the main function of the pressure converter shall be given.

Figure 3:
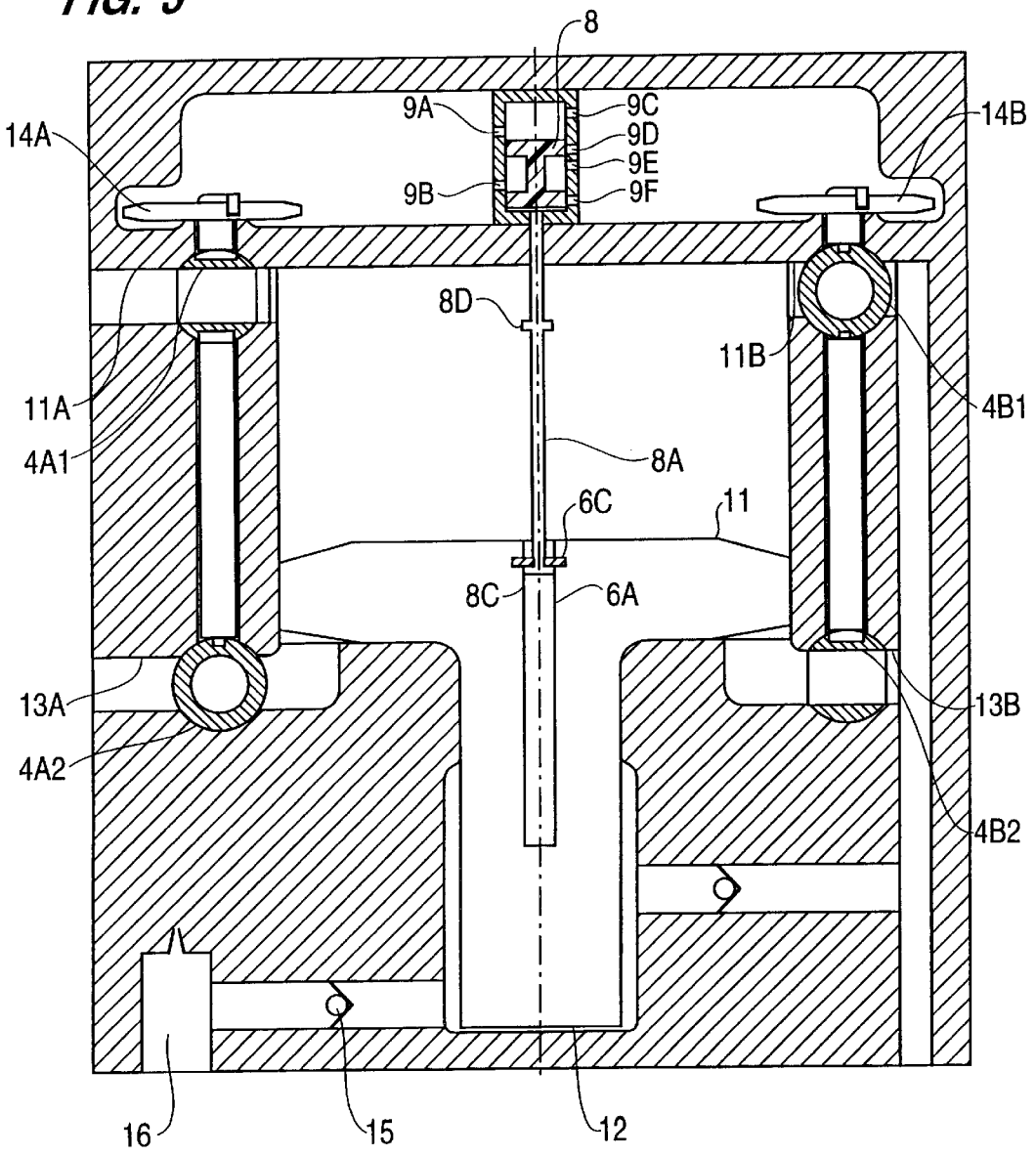
FIG. 3 shows a sectional view similar to FIG. 1, but with the piston in its lower end position.

Starting from the situation in FIG. 1, where piston 6 is in the upper position and valve ball 4B1 admits drilling fluid to the upper side of the piston through inlet channel 11B, piston 6 will be urged downwards. Fluid in piston area 13 at the underside of piston 6 will flow out through channel 13A and the open valve ball 4A2 to the annulus 50 between the drill string or the cylinder wall 1 and the casing (not shown). Thus, piston 6 will be driven downwards to its bottom position as shown in FIG. 3, and valve ball 4A1 will be opened for flow out to the outlet channel 11A.

Outside the cylinder end wall at the low pressure side as shown in FIG. 1 there is provided a control valve 9 with an associated slide member 8 having a slide rod 8A. This extends through the wall 2 and into a bore 6A in piston 6. The bottom of the bore is denoted 6B. Adjacent to the upper end of the bore there is provided an abutment element 6C for cooperation with an end piece or first entrainer element 8C at the lower end of slide rod 8A, and a second entrainer element 8D is located at an upper portion of rod 8. As will appear from the following description, the mutual axial spacing between both entrainer elements 8C and 8D should be approximately equal to or a little smaller than the stroke of the piston 6. Thus in the position shown in FIG. 1, slide member 8 has been displaced upwards to an upper position in control valve 9, due to the fact that abutment element 6C in bore 6A has engaged entrainer element 8D during the final portion of the upward movement of piston 6.

Control valve 9, which has various inlets and outlets 9A–9F, in cooperation with the movement of slide member 8 serves to control drilling fluid flows for the purpose of the repositioning or movement of the valve means as discussed above.

Figure 4:
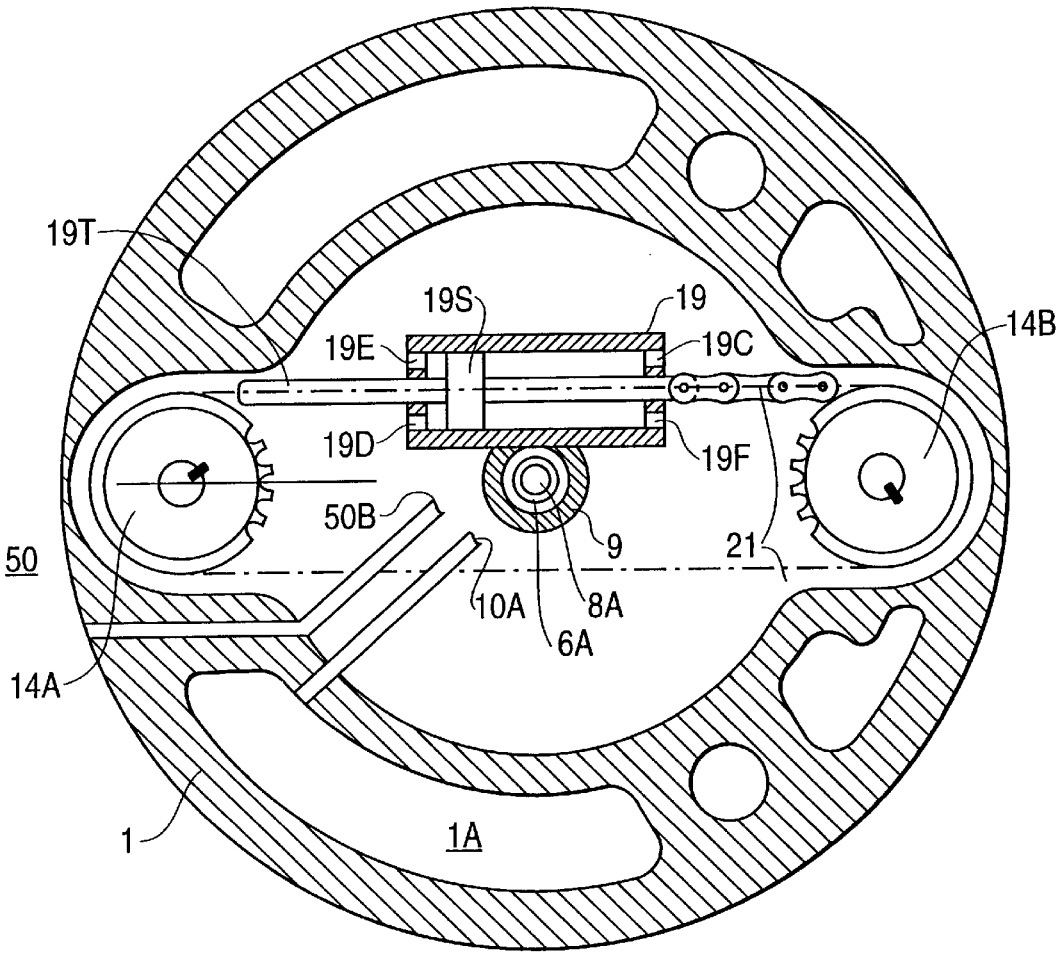
FIG. 4 shows a cross-section along the line IV—IV in FIG. 1.

FIG. 4 shows an actuator cylinder 19 having a transverse orientation with respect to the central longitudinal axis corresponding to bore 6A in piston 6 in FIG. 1. It should be noted that for simplicity FIG. 1 does not show the actuator cylinder 19 and FIG. 4 only shows a portion of control valve 9. FIG. 4 shows a transmission mechanism for converting the linear movements of a through-running slide rod 19T in the actuator cylinder 19 to the rotary movement of valve bodies 4A and 4B discussed above. This transmission mechanism comprises a chain element 21 engaging two gear wheels 14A and 14B which are keyed to the top of valve body 4A and 4B respectively (see FIG. 1). The two ends of chain element 21 are attached each to one end of the actuator slide rod 19T. Upon establishing a pressure difference between the two sides of the actuator piston 19S in cylinder 19, the slide rod 19T will provide for rotation of gear wheels 19A and 19B and the associated valve bodies.

It is obvious that the specific transmission mechanism illustrated in FIG. 4 can be modified in several ways, for example by replacing the chain element by a string or belt-like element, such that pulleys or the like without teeth could replace the wheels 14A and 14B. Another possibility would be to replace the gear wheels by simple arms and replace chain elements 21 by articulated links which were pivotally connected to slide rod 19T and the arms.

To achieve the desired control of drilling fluid flows through the displacement of the actuator piston 19S with accompanying repositioning of valve bodies 4A and 4B, the respective inlets and outlets 9C–9F in control valve 9 in FIG. 1 are connected to correspondingly designated inlets and outlets 19C–19F in actuator cylinder 19 in FIG. 4. Thus 9D in FIG. 1 is connected to 19D in FIG. 4 and so forth. In addition, FIG. 4 shows supply pipes or channels 50B and 10A respectively in communication with the annulus 50 and with one of the longitudinal passages 1A. Pipe 10A leads to inlet 9A in control valve 9 in FIG. 1, whereas pipe 50B leads to the opening 9B in the control valve. As a result of the connections described here, control valve 9 provides for the desired piston movement in actuator cylinder 19 so that the valve means is repositioned depending upon and coordinated with the reciprocating movement of piston 6.

In the embodiment of FIGS. 1–4, there are provided valve balls for inlet and outlet at the main piston areas or surfaces 11 and 13. Each valve body 4A and 4B has a longitudinal extension in parallel with the axis of piston 6, corresponding at least to the stroke of the piston. The dimensional relationships are determined by the need to supplying drilling fluid under pressure into piston area 11 during the pressure stroke, and into piston area 13 during the return stroke, respectively.

FIG. 3 shows the situation when piston 6 assumes a bottom position, from which a return stroke will be initiated when slide member 8B has been pulled down to its lower position causing the actuator cylinder to reset valve bodies 4A and 4B to the positions shown in FIG. 3. In the position shown in FIG. 3, drilling fluid will enter through valve ball 4B2 and channel 13B and enter piston area 13. Valve ball 4A1 and channel 11A permit discharge of drilling fluid from piston area 11 to annulus 50, which has a substantially lower pressure.

Figure 5:
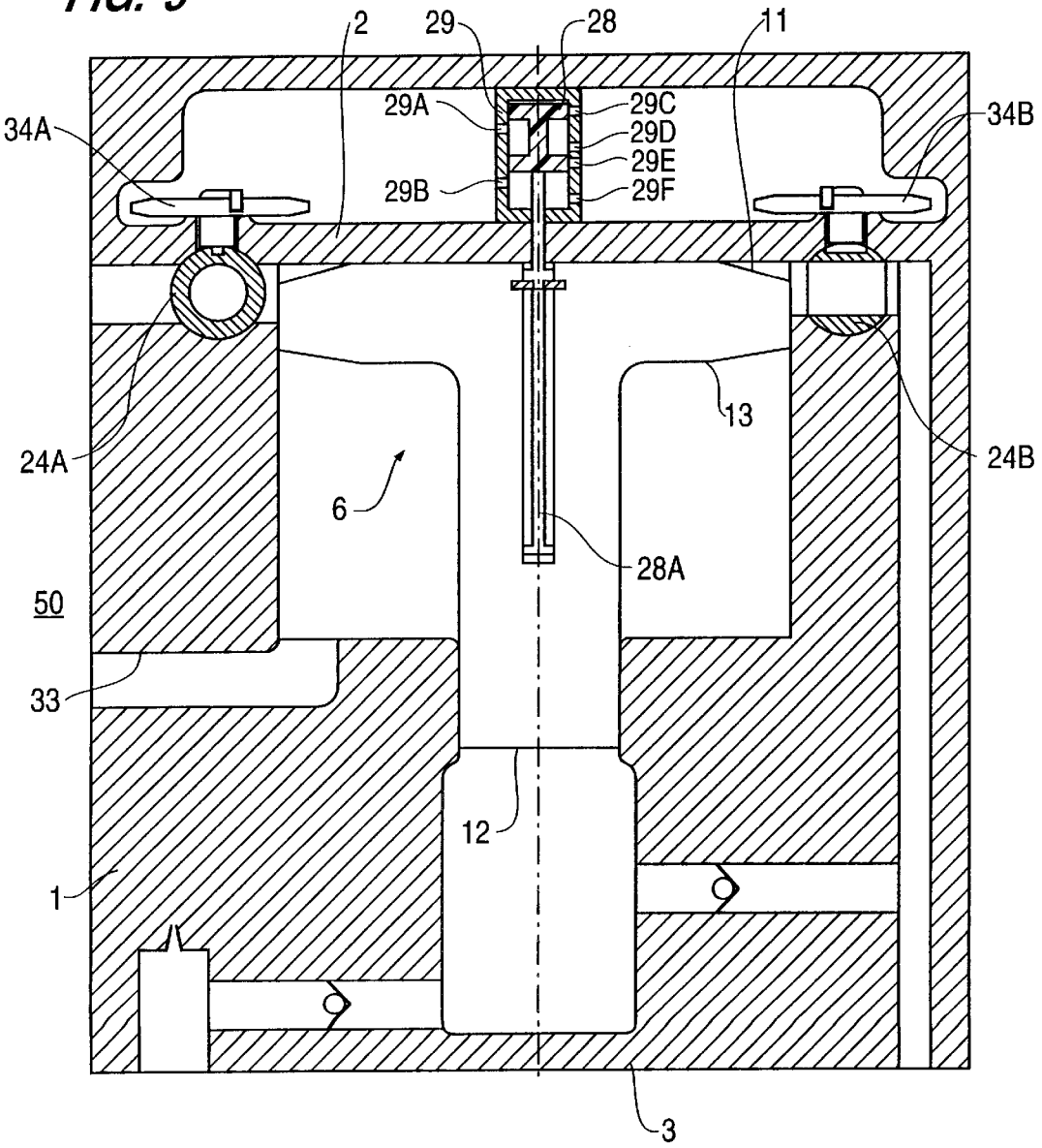
FIG. 5 shows a second embodiment of the pressure converter according to the invention, in a similar sectional view as FIG. 1, and FIG. 6 schematically shows a group of pressure converters based upon an upper pressure converter according to the embodiment in FIGS. 1–4, coupled to other pressure converters which have a simplified design.

FIG. 5 shows another embodiment, wherein each valve body has only one valve ball, i.e. ball 24A and 24B, each having associated gear wheels 34A and 34B respectively for generating valve movement similarly to what is described with reference to the preceeding FIGS. 1–4. Thus, in FIG. 5 there is provided a control valve 29 with a slide member 28 having the same function as control valve 9 and slide member 8 of FIG. 1.

Accordingly, in the embodiment of FIG. 5 there is no valve function controlling in-flow or out-flow from the volume in front of piston area 13, since this volume via a channel 33 communicates directly with the annulus 50 during all movement stages of piston 6. This is arrangement has been previously described, inter alia, in Norwegian patent 169.088. As in the previous design described in the above patent, FIG. 5 can also include a return compression spring adapted to exert a pushing force against piston area 13.

Also with respect to the valve and actuator device, the present invention can comprise embodiments having structural features other than those discussed above with reference to the drawings. Thus, for example, the valve means or arrangement can be based on a plate-shaped, rotatable valve body as shown, inter alia, in that patent specification referred to above. Instead of an actuator cylinder with a linear movement as shown and described herein, other forms of hydraulic actuators can be contemplated, being controlled by a control valve as described.

Figure 6:
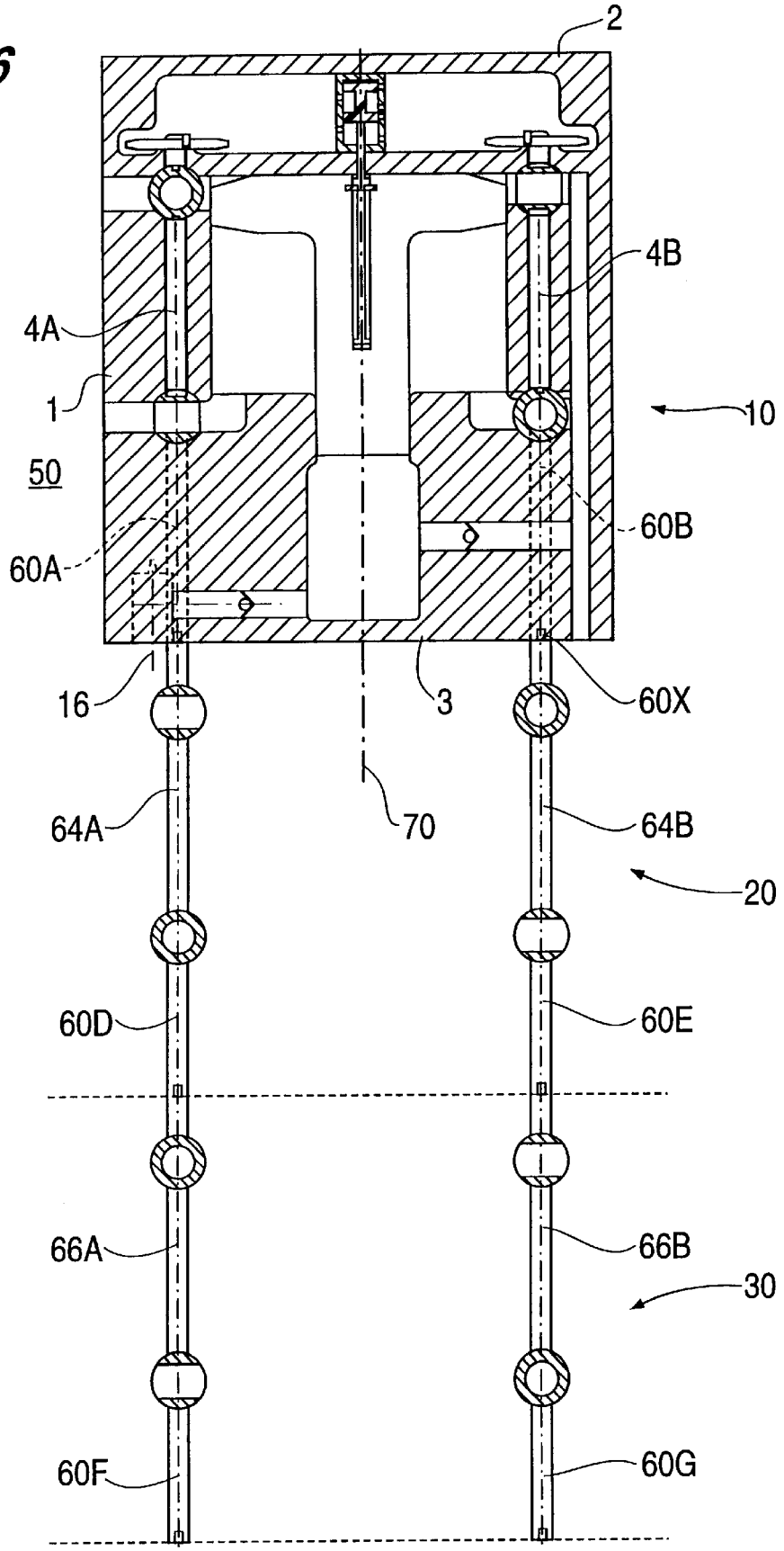

As in the previously known designs, in particular as described in Norwegian patent specifications Nos. 169.088 and 171.325, a pressure converter according to the present invention can be incorporated in a group of pressure converters for generating a larger drilling fluid flow at the desired increased pressure. FIG. 6 shows such a pressure converter group, wherein an upper pressure converter 10 is illustrated in the form of the same pressure converter embodiment as in FIGS. 1–4. Moreover in FIG. 6 there is schematically shown two further pressure converters 20 and 30, which possibly can be followed by still further pressure converters below them. In this arrangement, all of the pressure converters are provided with valve bodies with inter-connections in the longitudinal direction of the group, so that valve bodies 4A and 4B in the uppermost pressure converter 10, drive the whole series of valve bodies below, such as valve bodies 64A and 64B in pressure converter 20 and valve bodies 66A and 66B in pressure converter 30. These further pressure converters, for example 20 and 30, therefore can be of a simplified design without any specific means for bringing about the resetting movement of their valves.

As in the previously described pressure converter groups, the pressure converters 10, 20, 30 and so forth are aligned along a common longitudinal axis 70, with a common, through-running high pressure header channel 16 and with the respective valve bodies axially aligned in relation to each other. For inter-connecting the two strings of valve bodies shown, there are provided drive axles 60A–60G with associated axle couplings as shown for example at 60X between pressure converter 10 and pressure converter 20.

For equalizing pressure impulses in the total resulting high pressure flow in header channel 16, it may be an advantage to arrange the valve bodies in the pressure converter with angular orientations being alternately opposite, as will appear from the valve positions being indicated for the respective valve bodies in pressure converters 10, 20 and 30 in FIG. 6.

I claim:

1. A pressure converter for mounting above a drill bit at the lower end of a drill pipe for generating an increased fluid pressure by utilizing energy in a drilling fluid flowing downwards through said drill pipe, said pressure converter comprising:

a cylinder having a bore with a first section and a second section, said first section having a larger diameter than said second section;

a reciprocating piston having a first end, a second end, and an annular surface, said first end having a larger diameter than said second end, said annular surface formed at a transition between said first and second ends, said first end defining a first chamber in said first section of said bore, said second end defining a second chamber in said second section of said bore, and said annular surface defining a third chamber in said first section of said bore;

a first channel for connecting said first chamber to an annulus outside said drill pipe;

a drilling fluid valve for controlling drilling fluid flow through said first channel to and from said first chamber;

a second channel with a check valve for connecting said second chamber in fluid flow communication with said drill bit;

a third channel for connecting said third chamber to an annulus outside said drill pipe;

a control valve comprising a control valve body, a slide member moveable between opposite ends of said control valve body, a slide rod cooperating with said piston for moving said slide member in said control valve body; and an actuator for adjusting said drilling fluid valve to control drilling fluid flow to and from said first chamber, said actuator in fluid flow communication with said control valve and operated by drilling fluid pressure supplied from said control valve.

2. A pressure converter according to claim 1 wherein said first chamber is a low pressure chamber.

3. A pressure converter according to claim 1 wherein said piston has an axial bore for said slide rod and said pressure converter further comprises an abutment element disposed in said axial bore of said piston, and first and second entrainer elements spaced apart on said slide rod, said spacing being smaller than the stroke of said piston, for cooperation with said abutment element.

4. A pressure converter according to claim 1 wherein said actuator comprises an actuator cylinder having a transverse orientation in relation to the axis of said piston, said actuator further comprising a transmission mechanism for converting a linear movement of said slide rod into a rotary movement for operation of said drilling fluid valve.

5. A pressure converter according to claim 4 wherein said transmission mechanism comprises a belt and a pulley, said belt connected to at least one end of said slide rod and being engaged around at least a part of the circumference of said pulley, said pulley connected to said drilling fluid valve.

6. A pressure converter according to claim 1 wherein said drilling fluid valve comprises two valve bodies diametrically opposed to each other in relation to the axis of said piston.

7. A pressure converter according to claim 6 wherein each valve body comprises at least one valve ball adapted to be rotated approximately 90° between an open and a closed position.

8. A pressure converter according to claim 7 wherein said each valve body further comprises a longitudinal extension having an axis parallel to the axis of said piston, said longitudinal extension having a length at least equal to the stroke of said piston.

9. A pressure converter group comprising at least two pressure converters for mounting above a drill bit at the lower end of a drill pipe for generating an increased fluid pressure by utilizing energy in a drilling fluid flowing downwards through said drill pipe, wherein at least one of said pressure converters is a pressure converter according to claim 1, said pressure converter group comprising:

a high pressure channel running through each of said pressure converters in said pressure converter group and in fluid flow communication with said drill bit, said high pressure channel connected to said second channel of at least one of said pressure converters according to claim 1; and at least one drive axle and coupling for transferring rotary movements of at least one valve body in at least one pressure converter to at least one valve body in a second pressure converter.

10. A pressure converter group according to claim 9 wherein said valve bodies in said pressure converters have alternate, mutual angular displacements of 90° about a common longitudinal axis for equalizing the resulting pressure impulses in said high pressure channel.

* * * * *